United States Patent [19]

Takeda

[11] Patent Number: 5,003,957

[45] Date of Patent: Apr. 2, 1991

[54] INTERNAL COMBUSTION ENGINE WITH A MECHANICAL SUPER-CHARGER

[75] Inventor: Toshio Takeda, Nagoya, Japan

[73] Assignee: Aisin Seiki Kabushiki Kaisha, Kariya, Japan

[21] Appl. No.: 313,945

[22] Filed: Feb. 23, 1989

[30] Foreign Application Priority Data

Feb. 23, 1988 [JP] Japan ..... 63-38669

[51] Int. Cl.[5] ..... F02D 23/00

[52] U.S. Cl. ..... 123/564

[58] Field of Search ..... 60/600, 611; 123/564, 123/559.3

[56] References Cited

U.S. PATENT DOCUMENTS 4,611,568 9/1986 Onaka et al. ..... 123/564 X
4,727,847 3/1988 Takeda et al. ..... 123/564
4,883,041 11/1989 Mochizuki ..... 123/564

FOREIGN PATENT DOCUMENTS 3721522 2/1988 Fed. Rep. of Germany ..... 123/564
17138 1/1986 Japan ..... 123/564

*Primary Examiner*—Michael Koczo
*Attorney, Agent, or Firm*—Oblon, Spivak, McClelland, Maier & Neustadt

[57] ABSTRACT

An internal combustion engine has a mechanical super-charger in a conduit connecting the engine with a source of air for compressing the air in the conduit. A bypass passage connected to the conduit on opposite sides of the super-charger compressor is selectively closed by a pressure regulating valve having a valve member movable in response to a pressure differential on opposite sides of a diaphragm member. The diaphragm member is sensitive to a pressure change in the conduit occurring in response to movement of the throttle valve, and causes the valve member to open and reduce the load on the super-charger compressor when the throttle valve is closed.

1 Claim, 1 Drawing Sheet

INTERNAL COMBUSTION ENGINE WITH A MECHANICAL SUPER-CHARGER

BACKGROUND OF THE INVENTION

1. Field of the Invention

This invention relates to an internal combustion engine, and more particularly to an internal combustion engine with a mechanical super-charger used for automobiles.

2. Statement of Related Art

There have been proposed various types of super-chargers for internal combustion engines, such as for examples that in the Japanese patent application published in 1986 as 61-223223 or that in the Japanese patent application published in 1982 as 57-181928. However, these super-chargers have a drawback that fuel efficiency is sacrificed in order to increase the engine power.

SUMMARY OF THE INVENTION

It is therefore an object of the present invention to provide an internal combustion engine with a mechanical super-charger while obviating the above conventional drawback.

According to the present invention, the above and other objects, are accomplished by an internal combustion engine having a mechanical super-charger compressor in a first conduit connecting the engine with a source of air, for compressing air in the first conduit. A second conduit connects to the first conduit at positions upstream and downstream of the super-charger compressor while a pressure regulating valve has a valve member positionable in a closed position for fluidically closing the communication between the first and second conduits. A throttle valve is positioned in the first conduit and is movable between a closed position and an open position. Means are provided for selectively moving the valve member to fluidically open communication between the first and second conduits so that air compressed by the supercharger compressor may be bled to the second conduit for controlling the pressure difference between the upstream and downstream sides of the compressor. The means for selectively moving the valve member comprises means sensitive to a pressure change in the first conduit resulting from movement of the throttle valve into the closed position. As a result, a load on the super-charger compressor is reduced when the throttle valve is closed, i.e. when the engine is idling.

According to a further feature of the invention, the means for selectively moving the valve member further comprises means sensitive to a pressure level in the first conduit at the downstream side of the super-charger compressor exceeding a predetermined pressure level when the throttle valve is open, whereby the pressure regulating valve limits a maximum air pressure at the downstream side of the super-charger compressor.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
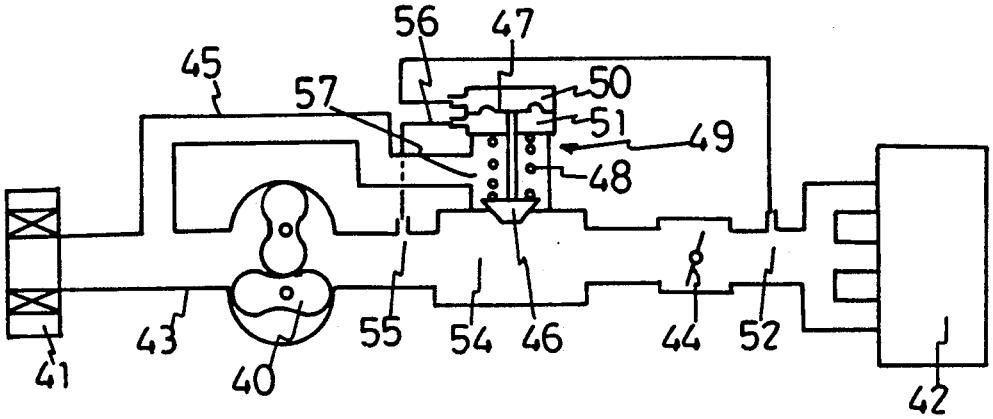
FIG. 1 is a schematic illustration of a first embodiment of the present invention.

Referring now to FIG. 1 of the attached drawings, a mechanical super-charger compressor 40 is disposed within the first conduit 43 of the air induction system connecting the air cleaner 41 with the engine 42. For example, a Roots type compressor mechanically driven by the engine is illustrated in the Figures. Within the conduit 43, between the engine 42 and the super-charger compressor 40, a throttle valve 44 is provided. A bypass passage (second conduit) 45 connects to the conduit 43 between the air cleaner 41 and the super-charger compressor 40 and also between the super-charger compressor 40 and the throttle valve 44 for by-passing the super-charger compressor 40. A pressure regulating valve 49 is disposed in the bypass passage 45. The regulating valve 49 includes a valve member 46 to regulate the fluid flow through the conduit 43. A pressure sensitive member in the form of a diaphragm 47 is connected to the valve member 46 via a rod member to open or close the valve member 46 by the movement of the diaphragm 47. Spring 48 is provided for urging the valve member 46 to its closed position for closing communication between the first conduit 43 and the bypass passage 45. The diaphragm 47 is in a housing which defines a first chamber 50 which is connected to a downstream conduit portion 52 of the conduit 43 via conduit 53, and a second chamber 51 which is connected to an upstream conduit portion 55 of the conduit 43 via a conduit 56, whereby the position of the diaphragm 47 is sensitive to a pressure change in the conduit 43 resulting from movement of the throttle valve 44. Number 54 designates a portion of conduit 43 positioned between the two portions 52 and 55 and having a larger diameter.

Referring now to the operation of this embodiment, when the throttle valve 44 is closed (engine idling operation) the conduit portion 52 is subject to a vacuum which creates a vacuum condition is the first chamber 50, via conduit 53. In this situation, the second chamber 51 is subject to a positive pressure from the conduit portion 55 which is pressurized by the super-charger compressor. Thus, due to the pressure differences between the chambers 50 and 51, the diaphragm 47 is moved upward to open the valve member 46, overcoming the force of spring 48. As a result, pressurized air in the conduit portion 54 is bled through bypass passage 45 to reduce the pressure differential upstream and downstream of the super-charger compressor 40. The super-charger compressor 40 thus will operate in a substantially unloaded condition to thereby save engine power.

When the throttle valve 44 is fully open (engine high rotation), the pressure at the conduit portion 52 is approximately the same as that at the conduit portion 55. Thus, the pressures in the first and second chambers 50 and 51 become approximately equal and the valve member 46 moves to or remains in its closed position due to the force of spring 48, to close the communication between the bypass passage 45 and the conduit portion 54 of the conduit 43.

The valve member 46 can also operate as an excess pressure relief valve to limit the maximum pressure in the conduit 43 downstream of the super-charger. When the throttle valve 44 is fully opened, the air pressure in the chamber portion 54 acting on the surface area of the valve member 46 will eventually become great enough to overcome the force of the spring 48, and so begin to open the valve member 46. During this time, the diaphragm 47 plays substantially no part since the conduit portions 52 and 55 will be at substantially the same pressure. As air pressure is bled off from the conduit portion 54 by the partial opening of the valve member 46, the air pressure in the conduit portion 54 will stabilize at a maximum compression pressure determined as a function of the predetermined spring force of the spring 48. The spring force of the spring 48 is thus set so as to balance the pressure in the conduit portion 54 at a maximum desired compression pressure. Similarly, the size of the diaphragm 47 is selected so that the pressure differential between the first and second chambers 50 and 51 is sufficient to overcome the spring having the predetermined spring force when the throttle valve 44 is closed.

Figure 2:
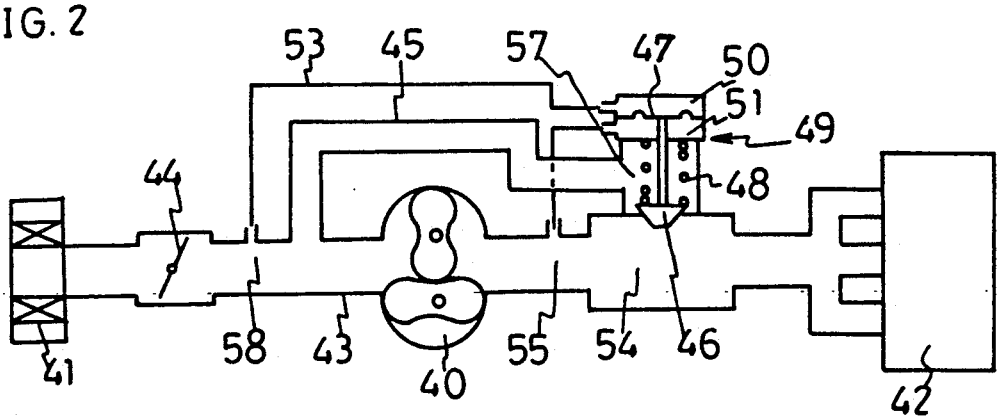
FIG. 2 is schematic illustration of a second embodiment of the present invention.

Referring to another embodiment of the invention shown in FIG. 2, in this embodiment super-charger compressor 40, bypass passage 45 and the pressure regulating valve 49 are disposed between the throttle valve 44 and the engine 42. The conduit portion 58 corresponds to the conduit portion 52 of the first embodiment and the other elements bear the same reference numerals as those in FIG. 1. It should be noted that in both embodiments the chamber 50 communicates with the portion 58 under all operating conditions, while the chamber 51 communicates with the portion 55 under all operating conditions.

The operation of this embodiment under the throttle closed condition is substantially the same as that in FIG. 1 and its description will be omitted.

When the throttle valve 44 of the second embodiment is fully opened, the downstream side (conduit portion 58) of the throttle valve reaches atmospheric pressure. On the other hand, the second chamber 51 of the pressure regulating valve 49 has a positive pressure because it is connected downstream of the super-charger compressor 40 (conduit portion 55). Thus, the diaphragm 47 receives a force urging the diaphragm 47 and valve member 46 upward in FIG. 2. The valve member 46 also receives a force urging the valve member 46 upward as viewed in FIG. 2, due to the positive pressure in the conduit portion 54 acting on the surface area of the valve member. When the combined force of these two forces exceeds the predetermined spring force, the valve member 46 is moved upward to limit the pressure downstream of the super-charger compressor.

Figure 3:
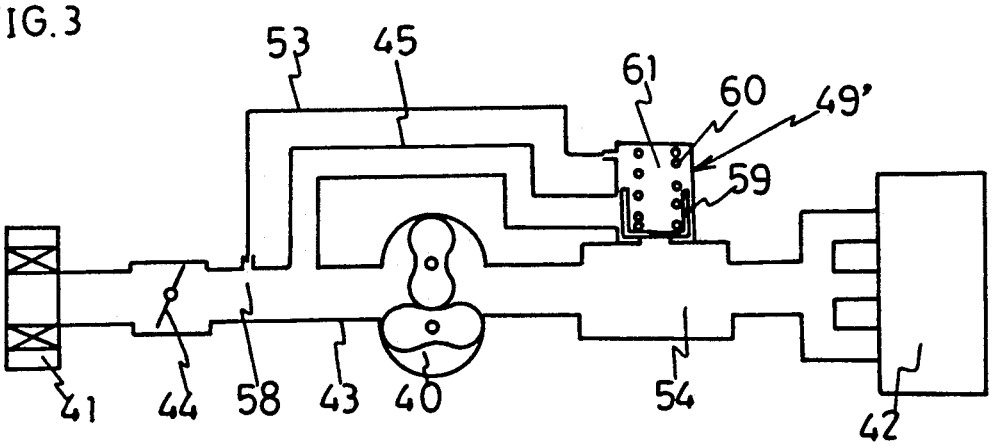
FIG. 3 is a schematic illustration of a third embodiment of the present invention.

Referring to FIG. 3, the system or arrangement of this embodiment is substantially the same as that in FIG. 2, except in the structure of the pressure regulating valve 49. In this embodiment, the pressure regulating valve 49' includes a piston-like slide valve 59 which acts as a pressure sensitive member, spring 60 which urges the slide valve in its closing direction and a chamber 61 which is connected to the conduit 53. When the throttle valve 44 is fully opened, the slide valve 59 is urged to close the communication between the conduit portion 54 and the bypass passage 45 by the force of spring 60. The region downstream of the throttle valve 44 (conduit portion 58) is at atmospheric pressure while the conduit portion 54 has a positive pressure, urging the slide valve 59 in its open direction against the spring force which maintains the slide valve closed.

When the force to urge the valve 59 to its open position exceeds the force of spring 60, however, the slide valve 59 is moved to open, to limit the pressure level in the conduit portion 54.

When the throttle valve 44 is fully closed, the pressure at the conduit portion 58 becomes a vacuum and the pressure at the chamber 61 of the pressure regulating valve 49' becomes a vacuum, thereby to open the valve member 59 due to the pressure difference between chamber 60 and the portion 54. Thus the super-charger compressor 40 has a reduced pressure difference between its upstream and downstream sides to reduce the engine load.

According to the present invention, the super-charger compressor maintains a predetermined downstream pressure level when the throttle valve is in its full open position and maintains the incoming and outgoing pressures at substantially the same level when the throttle valve is in its fully closed position. Under the partial throttle condition, the pressure varies in a conventional way in response to the opening degree of the throttle valve.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States:

1. An internal combustion engine having a mechanical super-charger, comprising:

a first conduit connecting said engine with a source of air;

a super-charger compressor in said first conduit for compressing air in said first conduit;

a second conduit connected to said first conduit at positions at upstream and downstream sides of said super-charger compressor;

a pressure regulating valve including a valve member positionable in a closed position for fluidically closing communication between said first and second conduits;

a throttle valve positioned in said first conduit upstream of said super-charger compressor and movable between a closed position and an open position;

a diaphragm mechanically connected to said valve member and having first a fluid chamber;

a spring biasing said valve member into the closed position;

means for communicating under all operating conditions said first fluid chamber with a portion of said first conduit at a position downstream of said throttle, wherein said first fluid chamber is on a side of said diaphragm such that movement of said throttle valve to the closed position produces a pressure change in said first fluid chamber for opening said valve member in opposition to said spring, whereby air compressed by said super-charger compressor may be bled to said second conduit;

a second fluid chamber on a side of said diaphragm member opposite said first fluid chamber; and means for communicating under all operating conditions said second fluid chamber with a portion of said first conduit downstream of said super-charger compressor, whereby said valve member comprises both means for reducing a load on said super-charger compressor when said throttle valve is closed and means for limiting a maximum air pressure at the downstream side of said super-charger compressor.

* * * * *